US005889241A

United States Patent [19]

Zambelli et al.

[11] Patent Number: 5,889,241

[45] Date of Patent: Mar. 30, 1999

[54] INDICATING DEVICE FOR ELEVATORS

[75] Inventors: Michael P. Zambelli; David C. Stowers, both of Upper Montclair; Robert J. Koeppe, Morristown, all of N.J.

[73] Assignee: Inventio AG, Hergiswilnw, Switzerland

[21] Appl. No.: 872,400

[22] Filed: Jun. 10, 1997

[51] Int. Cl.[6] ..... B66B 3/02

[52] U.S. Cl. ..... 187/397; D10/108; 187/391

[58] Field of Search ..... 187/395, 396, 187/397, 398, 391, 401, 413; D10/108

[56] References Cited

U.S. PATENT DOCUMENTS

| | | | |
|---|---|---|---|
| D. 254,484 | 3/1980 | Perjo | D10/108 |
| 4,032,882 | 6/1977 | Mandel et al. | 340/19 R |
| 4,924,974 | 5/1990 | Orndorff et al. | 187/397 |
| 5,433,295 | 7/1995 | Murphy | 187/397 |
| 5,565,661 | 10/1996 | Berdich et al. | 187/395 |

FOREIGN PATENT DOCUMENTS

| | | | |
|---|---|---|---|
| 1 773 352 | 4/1958 | Germany . | |
| 03 042480 | 2/1991 | Japan . | |
| 03 042481 | 2/1991 | Japan . | |
| 3-26677 | 2/1991 | Japan | 187/397 |
| 04159986 | 6/1992 | Japan . | |
| 07 228439 | 8/1995 | Japan . | |
| 08290884 | 11/1996 | Japan . | |

*Primary Examiner*—Robert E. Nappi

*Attorney, Agent, or Firm*—MacMillan, Sobanski & Todd, LLC

[57] ABSTRACT

A direction indicating device (4) for elevators is built into the door frame (3) near a floor door (1). The device (4) consists essentially of a retaining element (9), an up-direction arrow (10) and a down-direction arrow (11). In order to make the indicating device direction arrows (10, 11) visible from possibly all positions or viewing angles of the passengers on the floor, the device (4) is arranged on the door frame (3) three dimensionally with the direction arrows (10, 11) mounted on the front wall (14) as well as on the side wall (15) of the door frame (3). For further improvement of the visibility, another indicating device (4) can be arranged in a similar manner on the other side of the door frame (3). With the arrangement of this indicating device (4) on both sides of the floor door (1), a practically total visibility of the direction arrows (10, 11), through almost 180 degrees in the hallway, is assured.

13 Claims, 2 Drawing Sheets

INDICATING DEVICE FOR ELEVATORS

BACKGROUND OF THE INVENTION

The present invention relates generally to an indicating device for elevators and, in particular, to a direction indicator.

The German patent publication DE 1 773 352 shows illuminating indicating arrows for elevator installations which will light up on arrival of a passenger car at a floor and indicate the direction (up or down) of the continued travel. The indicating arrows, which are illuminated by incandescent light bulbs are housed in an indicating panel, which is flush mounted in the wall on each floor. In order that the indicating arrows are also visible from the side they exhibit the shape of truncated pyramids (frustums) protruding from the panel.

In the aforesaid indicating device the indicating arrows are arranged in a panel, which is mounted in an assembly box embedded into the walls at each floor. For this at least one recess has to be provided on each floor and for each elevator for the panel and openings, respectively ducts for the electrical leads in the wall which depending on the type of masonry brings with it a considerable expenditure of labor. Besides this, the size of the indicating device, respectively of the recess in the masonry differs, depending on the elevator or the type of the building, which in addition results in a large number of available different assembly boxes. Likewise the wiring and assembly of the indicating device during the installation of the elevator equipment requires an unnecessary cost.

The invention is based on the problem to propose an indicating device for elevators of the type cited in the aforementioned, which does not exhibit the disadvantages mentioned previously, and which can be mounted and exchanged in a simple manner, without having to undertake structural adaptations.

SUMMARY OF THE INVENTION

This problem is solved by the invention characterized in the following patent claims. The present invention concerns an indicating device for providing an elevator direction indication adjacent the elevator floor door including a retaining element for mounting on a generally vertically extending leg of an elevator floor door frame, the retaining element being bent about a generally vertical axis; an up-direction arrow on the retaining element and being bent along the generally vertical axis; and a down-direction arrow on the retaining element below the up-direction arrow and being bent along the generally vertical axis whereby the direction arrows are visible through an arc of approximately two hundred seventy degrees.

The advantages attained by the invention can be seen essentially in the fact, that by arrangement on the frame of the floor doors the indicating devices can be mounted and exchanged very rapidly. The wiring is accomplished directly through the door frame, without additional openings in the masonry being necessary.

By the measures stated in the subclaims it is possible to realize advantageous further developments and improvements of the indicating device with a direction indication for elevators as stated in the first claim. Based on the arrangement of the indicating device in a three-dimensional execution in the floor door frame the up and down direction arrows are visible to the passengers from any viewing angle. By such an arrangement on both sides of the door frame the visibility of direction arrows is further increased. The arrangement in the floor door frame results in a considerably more elegant and compact appearance without additional installations in the walls of the floors.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
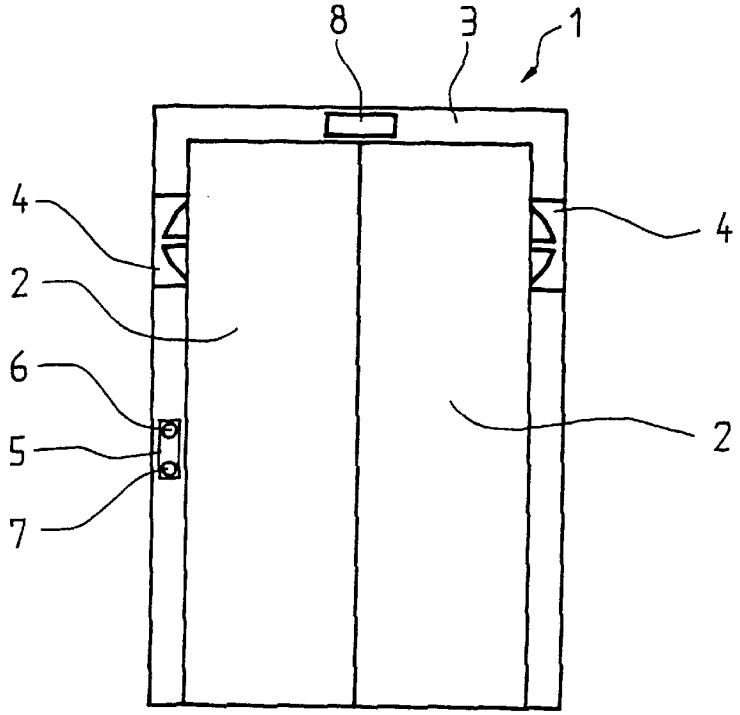
FIG. 1 is a view of a floor door of an elevator with indicating devices integrated in the frame in accordance with the present invention.

FIG. 1 shows a view of a floor door 1 with two door wings 2 of an elevator with indicating devices 4 integrated in the door frame 3 installed in the wall of a building hallway. The indicating device 4 informs the passenger, whether the next car will serve the upper or the lower floors. Likewise arranged in the door frame 3 are the call buttons 5, an up button 6 and a down button 7, as well as a floor indicator 8. The indicating device 4 can be placed optionally on one or both vertically extending side legs of the door frame 3.

Figure 2:
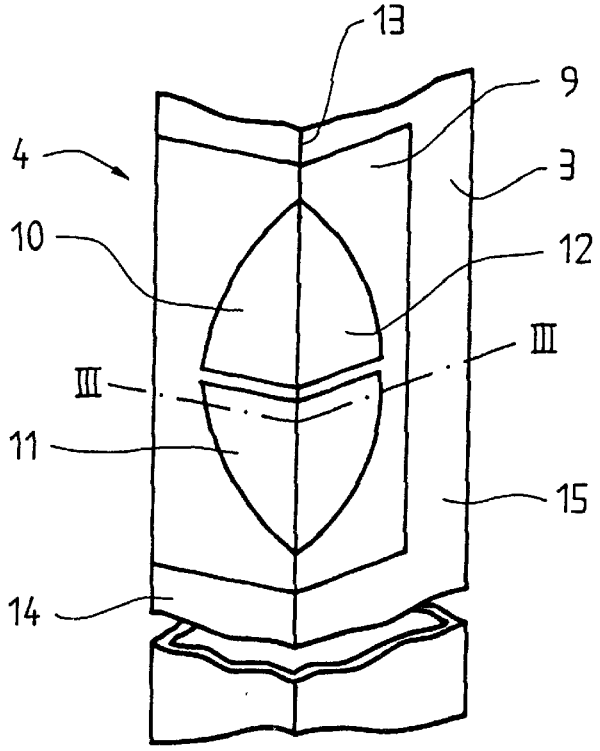
FIG. 2 is an enlarged perspective view of the indicating device shown in the FIG. 1.

FIG. 2 shows a detailed view of the indicating device 4 mounted in the left side leg of the frame 3. It consists essentially of a retaining element 9, mounted in an aperture in the door frame 3, an up-direction arrow 10 and a down-direction arrow 11. The direction arrows 10, 11 can be formed as transparent or translucent portions of the retaining element 9, or can be separate lenses attached to the retaining element. The direction arrows 10, 11 are illuminated by incandescent light bulbs or LED's (not shown) and exhibit a cover of glass or transparent plastic. For illumination it is possible to use colored incandescent light bulbs or LED's or also colored coverings 12. The up and down direction arrows 10, 11 can be the same piece as the retaining element 9. For example, the arrows 10, 11 can be a transparent area, and the remaining part of the retaining element 9 can be painted dark or non-transparent plastic.

In order to make the indicating device 4, respectively the direction arrows 10, 11 possibly visible from all positions or viewing angles of the passengers, it is arranged three-dimensionally on the door frame 3, which means that the direction arrows 10, 11 are mounted on a front wall 14, facing into the hallway, as well as on a side wall 15 facing the right leg of the door frame 3. Thus, the retaining element 9 and the lenses 10, 11 are bent along a generally vertical axis at an approximately right angle and are visible through an arc of approximately one hundred eighty degrees. This can be achieved as a one piece unit, that is with a single rectangularly bent cover 12 for each direction arrow 10, 11 or split with two covers each for the direction arrows 10, 11. The indicating device 4 covers thereby a vertical edge 13 of the door frame 3. In its mounted state the shape of the cover 12 should present an arrow-shaped symbol. In a single piece execution it can exhibit in its unbent state for example the shape of a semicircle or a triangle, etc.

For further improvement of visibility, the indicating device 4 can be arranged additionally in a similar manner on the right side leg of the door frame 3. With an arrangement of the indicating device 4 on both sides of the door frame 3 a complete visibility of almost 180 degrees of the direction arrows 10, 11 in the entire hallway is assured. Moreover the arrangement of the indicating device 4 in the narrow width door frame 3 results in a considerably more elegant and compact appearance, without additional installations separated from the door frame 3.

The wiring is carried out as also for the other components (call buttons 5, floor indicator 8) on the inside of the door frame 3. In this manner it is possible to mount all operating and indicating elements with or after mounting of the door frame 3, without having to prepare additional constructional recesses. Thereby expenditures of labor and costs are minimized.

Figure 3:
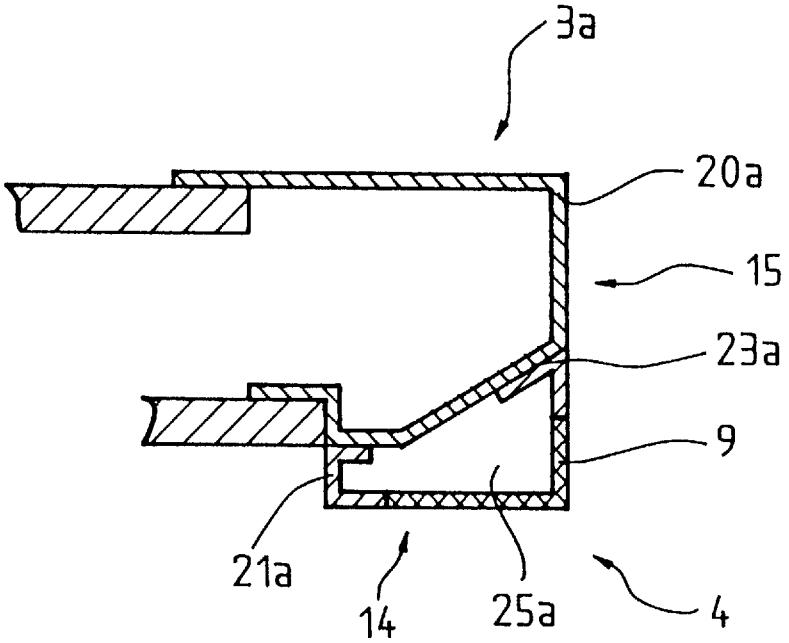
FIG. 3 is a cross-sectional view of an alternate embodiment of the indicating device as if taken along the line III—III in the FIG. 2.

FIG. 3 shows a cross sectional view through a shaft door frame 3*a* with a first variant or alternate mounting embodiment of the indicating device 4. The door frame 3*a* is fundamentally divided into two elements, namely into a mounting base 20*a* and an assembly frame 21*a*. Mounting base 20*a* and assembly frame 21*a* are each made of steel but can also be made of a light alloy material.

The assembly frame 21*a* serves at the same time as a cable duct 25*a* for the wiring of the elements. The mounting base 20*a* is fastened to the hall wall masonry by means of fastening elements, for example screws or bolts, not shown here in detail. Positioned on this is the assembly frame 21*a*, which is likewise attached to the mounting base 20*a*, by means of fastening elements, for example screws not shown. The indicating device 4 is inserted into a recess on the assembly frame 21*a* and attached with fastening elements, for example screws not shown. In the same manner also the other elements, the call buttons 5 and the floor indicator 8, can be attached to the assembly frame 21*a*.

The profile cross section of the assembly frame 21*a* can be of any desired shape, as shown in the FIG. 3 for example, with a connecting wall 23*a* extending at an angle between the front wall 14 and the side wall 15. However the connecting point 23*a* has to conform with the mounting base 20*a*. In any case, independently of the profile cross section, only the connecting edge on the side wall 15 of the door frame 3*a* is visible and does not affect in any way the optical appearance. Depending on the required space in the cable duct 25*a* a different profile can thus be chosen.

Figure 4:
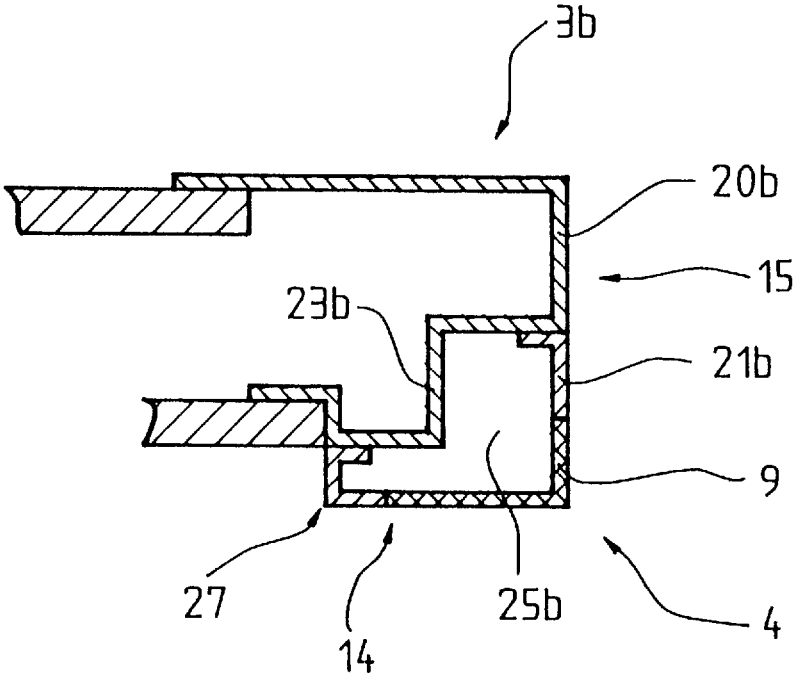
FIG. 4 is an view similar to the FIG. 3 showing another alternate embodiment of the indicating device according to the present invention.

FIG. 4. shows a cross section through a shaft door frame 3*b* with a second alternate embodiment or variant of execution. The profile cross sections of the mounting base 20*b* and the assembly frame 21*b* in this example of execution are different from those shown in the FIG. 3 and offer more space for the wiring in the cable duct 25*b* due to an L-shaped portion of the connecting wall 23*b*. An edge 27, visible from the hallway is formed by the assembly frame 21*b*. This edge 27 can be beveled, rounded or left edged depending on the design wishes.

In summary, the indicating device 4 for providing an elevator direction indication adjacent the elevator floor door 1 comprises: the retaining element 9 for mounting on a generally vertically extending leg of the elevator floor door frame 3, 3*a*, 3*b*, the retaining element being bent about a generally vertical axis; the up-direction arrow 10 on the retaining element and being bent along the generally vertical axis; and the down-direction arrow 11 on the retaining element below the up-direction arrow and being bent along the generally vertical axis whereby the direction arrows are visible through an arc of approximately two hundred seventy degrees.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An indicating device for providing an elevator direction indicating adjacent an elevator floor door comprising:

a door frame having a pair of generally vertically extending legs for installation along opposite sides of an elevator floor door in a wall of a building hallway, said door frame legs each having a front wall and a side wall extending generally at right angles to one another at a generally vertically extending edge of said door frame, each said edge extending along an associated generally vertical axis;

at least one retaining element mounted on one of said legs of said door frame and being bent along said associated generally vertical axis;

an up-direction arrow for indicating an up direction of continued travel for an elevator car at the floor door on said one retaining element and being bent along said associated generally vertical axis; and a down-direction arrow for indicating a down direction of continued travel for an elevator car at the floor door on said one retaining element and being bent along said associated generally vertical axis whereby said direction arrows extend about said edge of said door frame.

2. The indicating device according to claim 1 wherein said one leg includes a generally vertically extending mounting base for attachment to a wall of a building hallway and a generally vertically extending assembly frame attached to said mounting base and wherein said one retaining element is mounted to said assembly frame.

3. The indicating device according to claim 2 wherein said retaining element and said assembly frame cooperate to form a cable duct.

4. The indicating device according to claim 1 wherein each of said direction arrows is formed as a single piece bent cover attached to said one retaining element.

5. The indicating device according to claim 1 wherein each of said direction arrows is formed as two covers attached to said one retaining element.

6. An indicating device for providing an elevator direction indication adjacent an elevator floor door comprising:

a door frame having generally vertically extending legs for installation along opposite sides of an elevator floor door in a wall of a building hallway, said door frame legs each having a front wall and a side wall extending generally at right angles to one another at a generally vertically extending edge of said door frame;

a pair of retaining elements, each of said retaining elements being mounted on an associated one of said legs of said door frame and being bent about said edge of said associated one of said legs;

an up-direction arrow for indicating an up direction of continued travel for an elevator car at the floor door on each of said retaining elements and being bent about said edge of said associated one of said legs; and a down-direction arrow for indicating a down direction of continued travel for an elevator car at the floor door on each of said retaining elements and being bent about said edge of said associated one of said legs.

7. An indicating device for an elevator, the elevator having a door frame extending about an elevator floor door in a wall of a building, comprising:

a retaining element adapted to be mounted on a generally vertically extending leg of an elevator door frame, the leg having a front wall and a side wall extending at an angle from one another at a generally vertically extending edge of the leg, said retaining element being shaped to bend along a generally vertical axis at approximately the angle that the walls extend from the edge; and at least one indicating portion on said retaining element for providing an elevator indication, said one indicating portion being at least partly transparent to light and being bent along the generally vertical axis whereby when said retaining element is mounted on the leg at the edge, said retaining element and said indicating portion each extend along the front wall and the side wall of the leg to provide increased visibility of said indicating portion to a passenger approaching the elevator door frame.

8. The indicating device according to claim 7 wherein said indicating portion is formed integral with said retaining element.

9. The indicating device according to claim 7 wherein said indicating portion is formed as a single piece bent cover attached to said retaining element.

10. The indicating device according to claim 7 wherein said indicating portion is formed as two covers attached to said retaining element on opposite sides of said generally vertical axis.

11. The indicating device according to claim 7 wherein said indicating portion is formed as at least one direction arrow for indicating a direction of continued travel for an elevator car associated with the elevator door frame.

12. The indicating device according to claim 1 wherein said indicating portion is translucent to light.

13. The indicating device according to claim 1 wherein said indicating portion is transparent to light.

* * * * *